US005669037A

United States Patent [19]

Sugiyama

[11] Patent Number: 5,669,037

[45] Date of Patent: Sep. 16, 1997

[54] TONER CONCENTRATION CONTOLLER

[75] Inventor: Tsukasa Sugiyama, Osaka, Japan

[73] Assignee: Mita Industrial Co., Ltd., Osaka, Japan

[21] Appl. No.: 609,247

[22] Filed: Mar. 1, 1996

[30] Foreign Application Priority Data

Mar. 7, 1995 [JP] Japan ..... 7-046761

[51] Int. Cl.[6] ..... G03G 21/00

[52] U.S. Cl. ..... 399/58; 399/27; 399/29

[58] Field of Search ..... 399/27, 29, 45, 399/43, 58, 258, 260

[56] References Cited

U.S. PATENT DOCUMENTS

| | | | |
|---|---|---|---|
| 4,589,762 | 5/1986 | De Schamphelaere et al. | 399/260 X |
| 4,721,978 | 1/1988 | Herley | 355/208 X |
| 4,734,737 | 3/1988 | Koichi | 399/58 |
| 4,847,659 | 7/1989 | Resch, III | 399/58 |
| 4,969,011 | 11/1990 | Faull et al. | 399/260 X |
| 5,040,023 | 8/1991 | Yokoyama | 399/58 |
| 5,204,669 | 4/1993 | Birnbaum et al. | 399/27 X |
| 5,459,556 | 10/1995 | Acquaviva et al. | 399/58 |

*Primary Examiner*—Matthew S. Smith

*Attorney, Agent, or Firm*—Beveridge, DeGrandi, Weilacher & Young, LLP

[57] ABSTRACT

A toner concentration controller which activates a toner replenishing motor to replenish toner when the concentration of the toner in a developer unit which develops an electrostatic latent image on a photoreceptor drum is a predetermined value or lower. The ON period of the toner replenishing motor is controlled based on paper feed information (e.g. preset development quantity, both-side/one-side copying, and development speed) of a copy sheet to which the developed image is to be transferred.

2 Claims, 8 Drawing Sheets

T
ON
OFF

TONER CONCENTRATION CONTOLLER

BACKGROUND OF THE INVENTION

1. Field of the Invention

The present invention relates to a developer unit which develops an electric latent image on the surface of a photoreceptor by using a developer containing a magnetic carrier and a non-magnetic toner and to a toner concentration controller used for the developer unit.

2. Description of the Prior Art

Typically, the toner concentration of a developer unit of this type is determined based on a result of a comparison between a predetermined reference value and a toner-to-carrier ratio in a mixture of toner and carrier detected by a permeability sensor. The output of the permeability sensor increases as the toner concentration decreases, and decreases as the toner concentration increases. Therefore, when the sensor output is higher than the reference value, toner is replenished to maintain the toner concentration constant. The toner replenishment is performed by controlling ON/OFF of a toner replenishing motor, that is, by repeating an ON period and an OFF period alternately within a predetermined period of time.

However, the toner consumption greatly differs according to whether one-side copying or both-side copying is performed. This applies to the paper size and the preset copy quantity. Therefore, in these cases, with the same amount of toner replenishment, images may be faint because of insufficient toner, or the fogging on images or the locking of the developer unit (a condition in which the rotary members in the developer unit have difficultly in rotating because of excessive toner) may occur because of excessive toner replenishment.

SUMMARY OF THE INVENTION

An object of the present invention is to provide a toner concentration controller capable of a toner concentration control in accordance with such development conditions.

To achieve the above-mentioned object, according to the present invention, a toner concentration controller which activates and deactivates a toner replenishing motor to replenish a toner when a concentration of the toner in a developer unit which develops an electrostatic latent image on a photoreceptor is lower than or equal to a predetermined reference value, is provided with controlling means for controlling ON and OFF periods of the toner replenishing motor based on paper feed information (e.g. preset development quantity, both-side/one-side development, and development speed) of a copy sheet to which the developed image is to be transferred.

According to such features, for example, when the paper size is large, the ON period of the toner replenishing motor is long and the OFF period thereof is short, so that the amount of toner replenishment is large. On the contrary, when the paper size is small, the ON period is short and the OFF period is long, so that the amount of toner replenishment is small. As a result, the toner concentration in the developer unit is neither excessively low nor excessively high.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
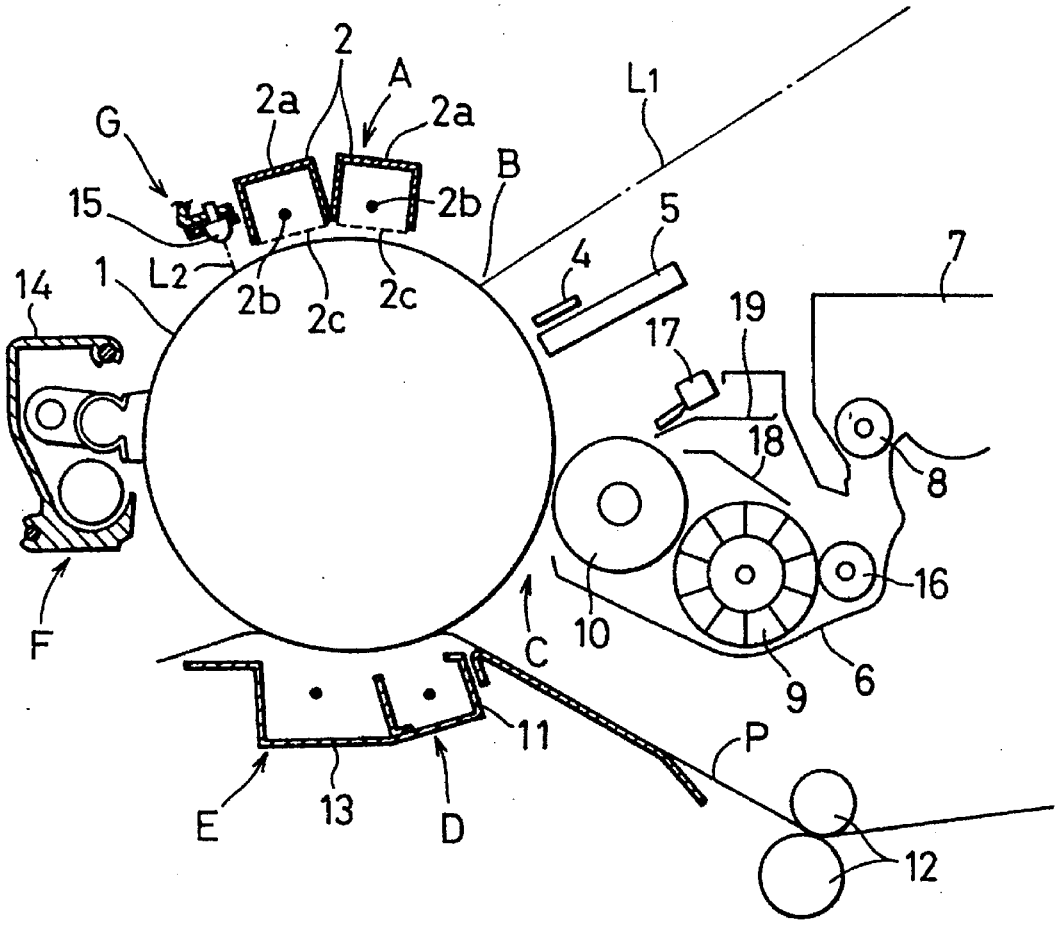
FIG. 1 is a schematic view of the relevant portion of the electrographic copying machine incorporating the toner concentration controller of the present invention.

Hereinafter, an embodiment in which a device according to the present invention is employed for an electrographic copying machine will be described with reference to the drawings. Referring to FIG. 1, there is schematically shown the structure of the electrographic copying machine. Reference numeral 1 represents a photoreceptor drum serving as an electrostatic latent image carrier. The drum 1 includes a drum base made of a metal such as aluminum on which a selenium photosensitive material is deposited to form a photosensitive layer, and is rotated clockwise in the figure at a constant speed.

In the periphery of the drum 1, the following sections are arranged in this order along the rotation direction (movement direction) of the drum 1: a charging section A, an exposure section B, a development section C, a transfer section D, a separation section E, a cleaning section F, and a charge removal section G.

In the charging section A, a pair of chargers 2 are disposed adjacent to each other. The chargers 2 are both positioned to look toward the axial center of the drum 1 and to be close to the drum surface to face it. The surfaces of the chargers 2 which face the drum 1 are open. In each of shield cases **2*a* disposed in parallel with the drum axis, a charging wire 2*b* composed of a fine tungsten wire is stretched along the length of the shield case 2*a*, and a grid electrode 2*c* made of a conductive material having a plurality of openings is provided at the open surface of the shield case 2*a***.

Typically, a high voltage of approximately 4 to 6 kV is applied to the main wires **2*b*. When the high voltage is applied to the chargers 2, a corona discharge occurs to charge the drum surface. The potential of the surface of the drum 1** thus charged is normally approximately 1000 V.

When the drum 1 rotates so that the charged surface reaches the exposure section B, a reflection light $L_1$ of an original image is irradiated onto the charged drum surface through a non-illustrated optical system to expose the surface. In this case, only the surface potential of the exposed portion is reduced through optical attenuation in correspondence with the exposure amount, so that an electrostatic latent image is formed.

Disposed just in front of the development section C in the drum rotation direction is a potential sensor 4 the measurement value of which is used in order that the charging potential of the drum surface at the development section C is a target value. Since the potential of the drum surface charged at the charging section A is dark-decayed while the drum 1 is rotating to the development section C, the drum surface potential is reduced to approximately 820 V when the drum surface reaches the development section C. That is, the drum surface potential is necessarily approximately 820 V at the development section C, and the voltage applied to the chargers 2 at the charging section A is set so that the surface is charged to a potential (1000 V) allowing for the dark decay. In other words, in order that the surface potential of the drum surface at the development section C is the target value 820 V, the measurement value of the surface potential at the potential sensor 4 is necessarily 850 V. Therefore, the charging potential of the charging section A is set to a value so that the measurement value is 850 V and the value is the 1000 V.

Reference numeral 5 represents an image erasing blank lamp disposed adjacent to the potential sensor 4. The blank lamp 5 includes light emitting diode (LED) arrays. When the user intends to erase a part of an electrostatic latent image for a purpose such as specifying an image area, necessary LEDs are selectively turned on so that the portion of the electrostatic latent image irradiated by the LEDs which are on is optically attenuated and erased.

Disposed in the development section C are a developer unit 6 and a toner hopper 7 which supplies toner to the developer unit 6. In this arrangement, the toner contained in the toner hopper 7 is supplied into the developer unit 6 by a necessary amount through a sponge roller 8 (toner replenishing roller). The non-magnetic toner and magnetic carrier (iron powder) are agitated by an agitating roller 9 in the developer unit 6, and the toner held by the carrier adheres to the surface of a development magnetic roller 10. When the portion of the drum 1 on which an electrostatic latent image is formed reaches the development section C, the toner in the developer unit 6 electrically adheres to the drum surface according to the electrostatic latent image through the development magnetic roller 10, thereby forming a toner image.

Disposed in the transfer section D is a transfer charger 11. When the drum 1 reaches the transfer section D, a sheet P is fed through a pair of paper feeding rollers 12 of a paper feeding section onto the drum surface, and a voltage of a polarity opposite to that of the toner is applied to the transfer charger 11 to transfer the toner image formed on the drum surface to the sheet P. Disposed in the separation section E is a separating charger 13 which applies an alternating current (AC) electrical field to the drum surface to thereby release the sheet P from being attracted to the drum 1, so that the sheet P to which the toner image has been transferred is separated from the drum 1.

Disposed in the cleaning section F is a cleaning unit 14 which removes things such as toner adhering to the drum surface from the drum surface by scrubbing the drum surface. The residual toner on the drum surface reaches the cleaning section F and is removed by the cleaning unit 14. Then, at the charge removal section G, a charge removing light $L_2$ of a charge removing lamp 15 irradiates the drum surface to optically attenuate the surface potential of the drum 1, so that the charge is removed.

Then, the drum 1 returns to the charging section A to be ready for the next copying process. When the continuous copying is set, the above-described copying process is repeated arbitrarily set times.

Figure 2:
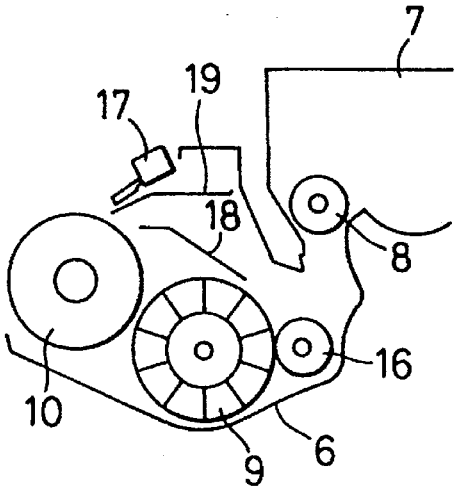
FIG. 2 is a view of the developer unit used in the copying machine.

Referring to FIG. 2, there is shown the above-described developer unit. Reference numeral 16 represents a mixing spiral. Reference numeral 17 represents a toner concentration sensor. The toner concentration sensor 17 is a permeability sensor. Reference numeral 18 represents a partition. Reference numeral 19 represents a doctor blade.

Figure 3:
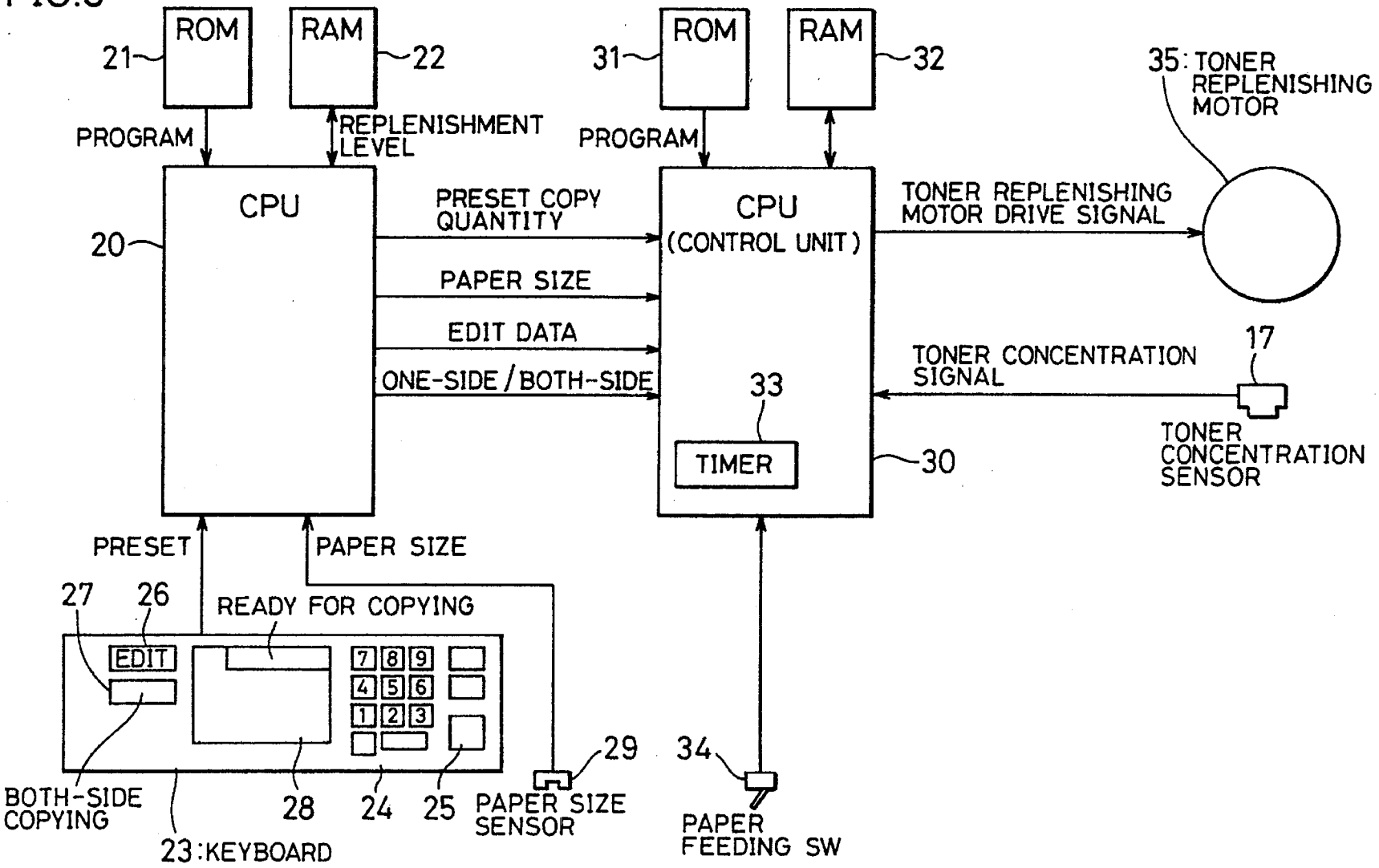
FIG. 3 is a block diagram of the toner concentration controller.

Referring to FIG. 3, there is shown a block diagram of a control system of the toner concentration controller. Reference numeral 20 represents a central processing unit (CPU) of an operation unit. Reference numeral 21 represents a read only memory (ROM) storing a program for the CPU 20. Reference numeral 22 represents a power-backed-up random access memory (RAM) Reference numeral 23 represents a keyboard connected to the CPU 20 and including a ten key 24, a copy key 25, an edit key 26, a both-side copying specifying key 27 and a display 28. The CPU 20 is also connected to a paper size sensor 29 provided in a paper feeding section. Reference numeral 30 represents a CPU of a control unit which performs data transmission and reception with a program storing ROM 31 and a RAM 32. The CPU 30 is also connected to a paper feeding switch 34. The CPU 30 is provided with a timer 33.

Reference numeral 35 represents a toner replenishing motor which drives the toner replenishing roller 8. When the power is turned on, the CPU 30 receives a reference toner concentration value from the RAM 22 through the CPU 20 of the operation unit and stores it in the RAM 32. Then, receiving an output of the toner concentration sensor 17, the CPU 30 compares the output with the reference value. The toner concentration is low when the output of the toner concentration sensor 17 is high and high when the output is low. Therefore, when the output of the sensor 17 exceeds the reference value, the CPU 30 generates a toner replenishment drive signal to activate/deactivate the toner replenishing motor 35 for a predetermined period of time.

Figures 4A, 4B, 4C:
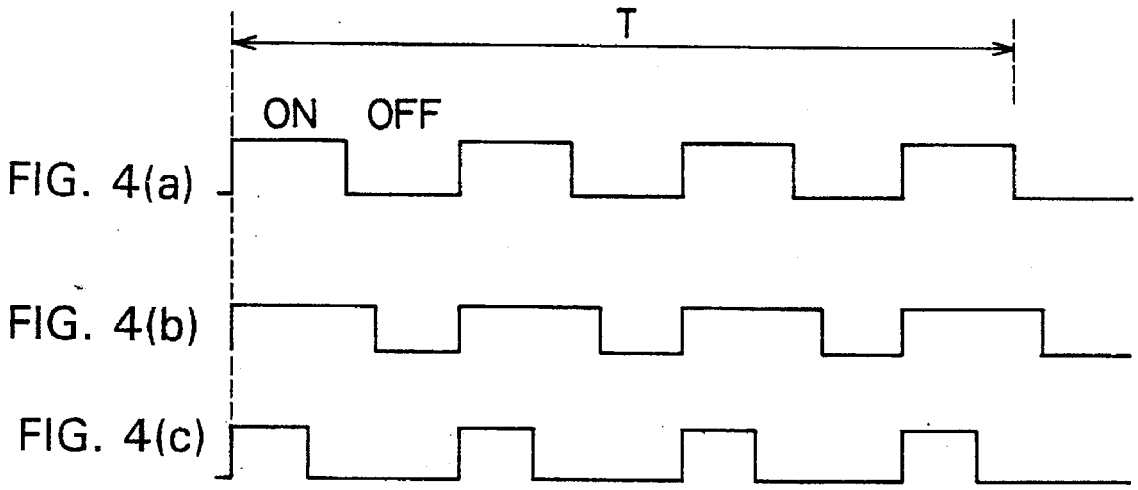
FIG. 4 is a view of assistance in explaining the control operation by the toner concentration controller.

Referring to FIG. 4, there is shown ON and OFF periods of the motor within a toner replenishment period T. (a) shows the ON and OFF periods in a toner replenishment for the normal copying. (b) shows the ON and OFF periods in a toner replenishment for a copying in which toner consumption per unit time is large. (c) shows the ON and OFF periods in a toner replenishment for a copying in which toner consumption per unit time is small. In (b), the ON period is long and the OFF period is short, whereas in (c), the ON period is short and the OFF period is long.

Figure 5:
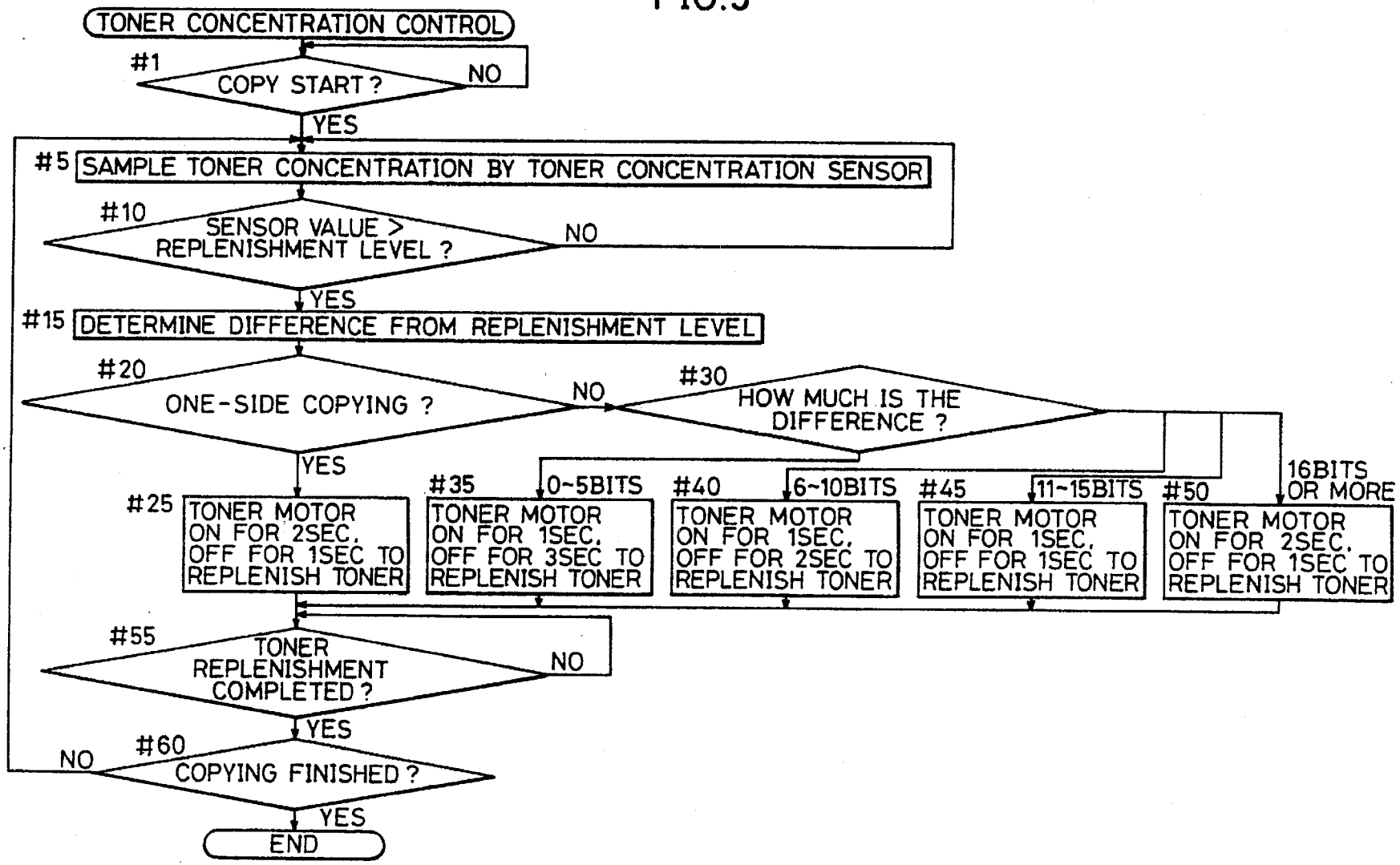
FIG. 5 is a flowchart of the control operation performed when the paper feed information is whether both-side copying or one-side copying is performed.

In this embodiment, whether toner consumption per unit time is large or small is determined based on paper feed information. FIG. 5 shows an example in which the paper feed information is whether both-side copying or one-side copying is performed. The both-side/one-side copying information is generated according to whether the user depresses the both-side copying specifying key 27 on the keyboard 23 or not, and is recognized by the CPU 30 by being transmitted from the keyboard 23 through the CPU 20 to the CPU 30.

Figure 6:
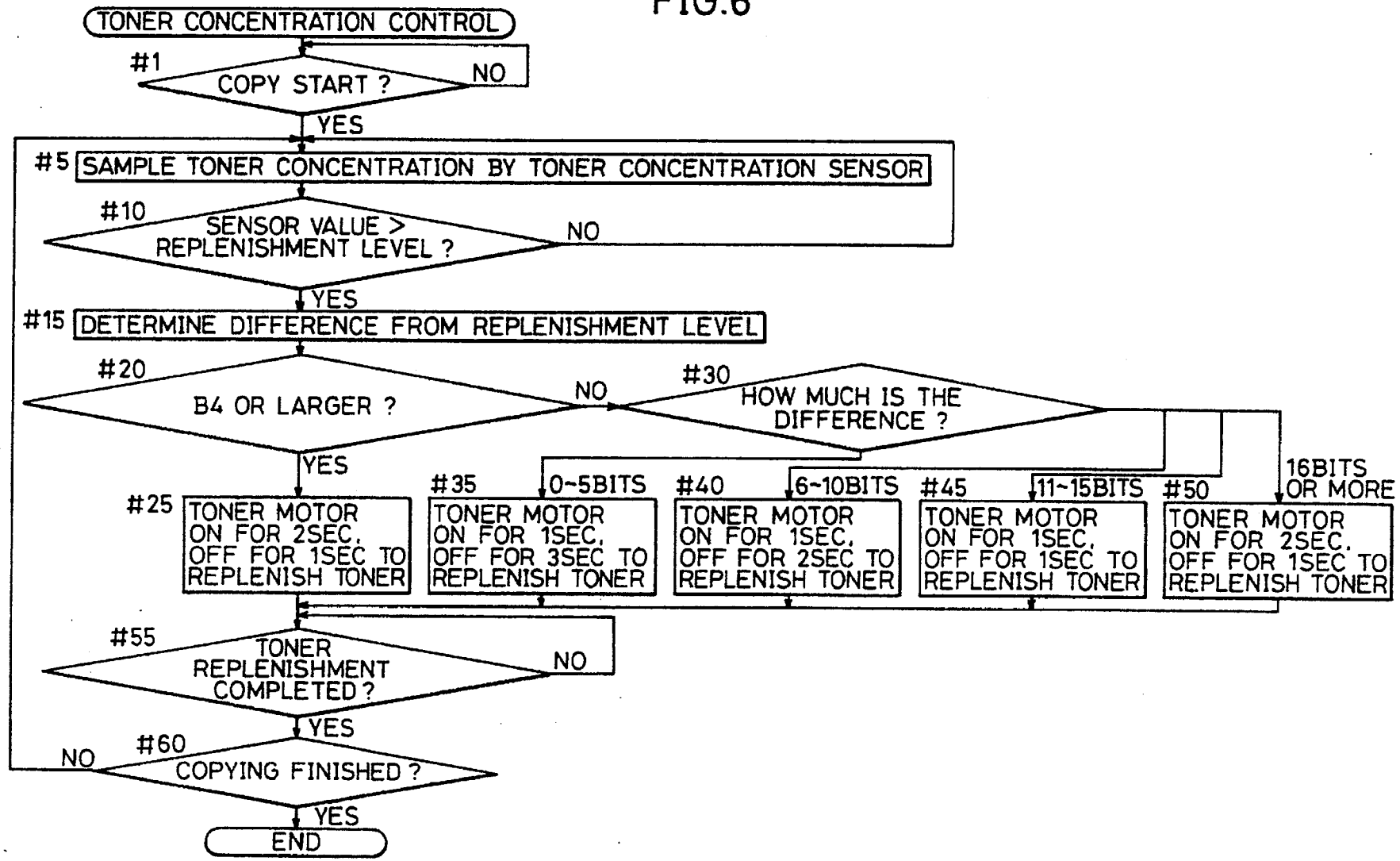
FIG. 6 is a flowchart of the control operation performed when the paper feed information is the paper size.
Figure 7:
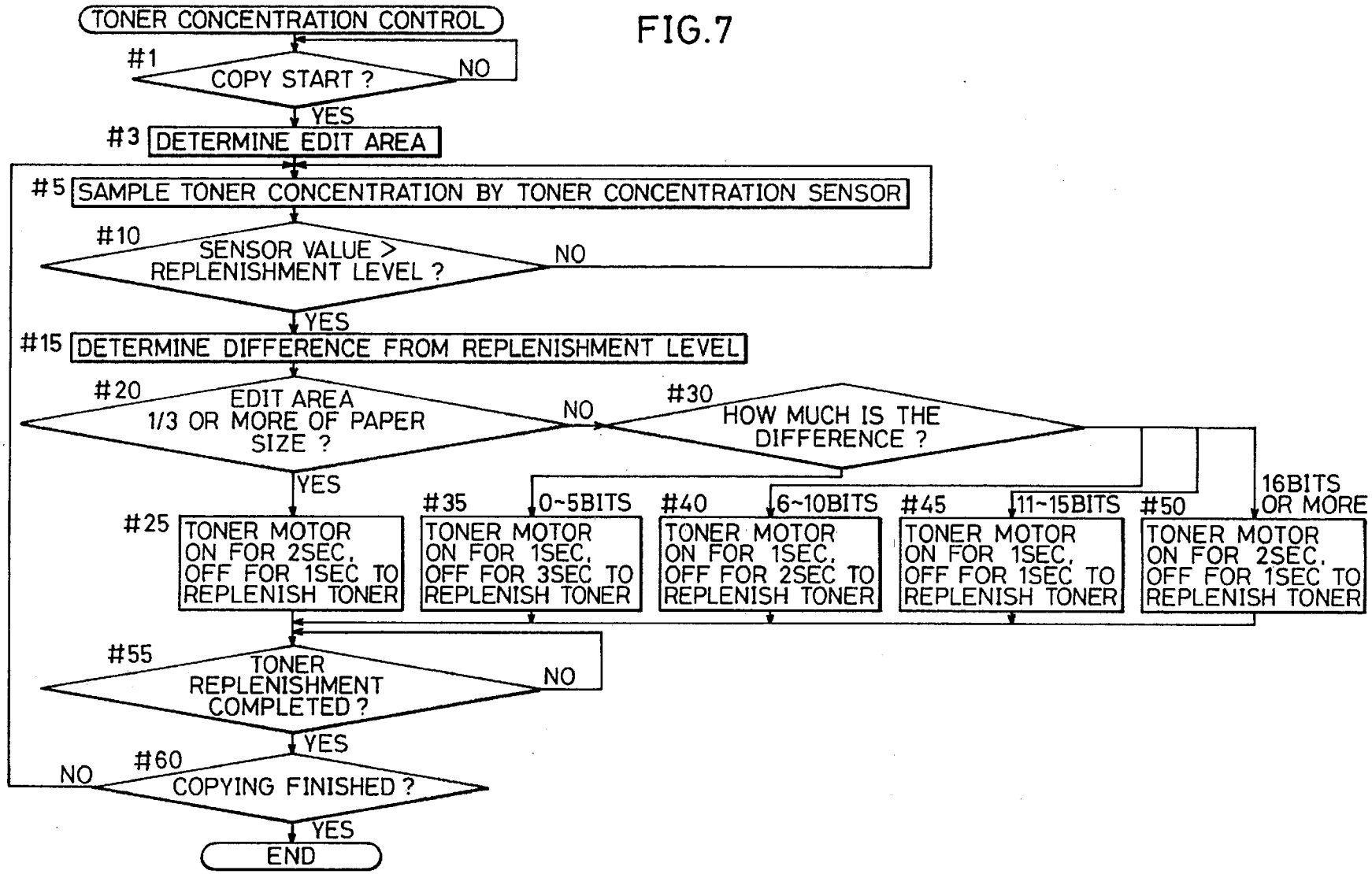
FIG. 7 is a flowchart of the control operation performed when the paper feed information is the developed region on the copy sheet.
Figure 8:
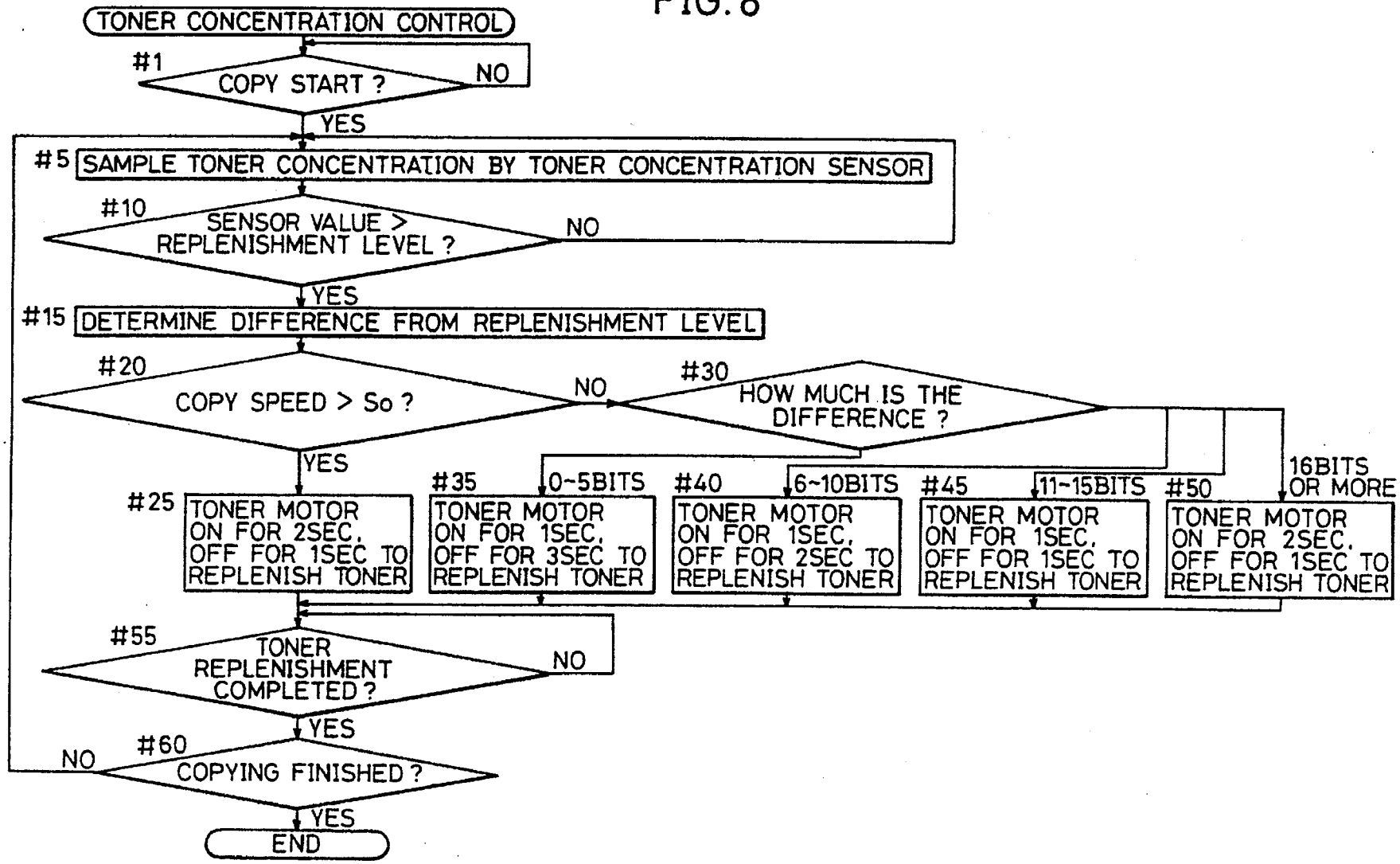
FIG. 8 is a flowchart of the control operation performed when the paper feed information is the copy speed.

FIG. 6 shows an example in which the paper feed information is the paper size. The paper size information is generated by the paper size sensor 29 and transmitted through the CPU 20 to the CPU 30. FIG. 7 shows an example in which the paper feed information is the ratio between the edit area and the paper size, i.e. the area of the transferred region. The ratio is calculated by the CPU 30 based on edit area information from the keyboard 23 and the paper size information from the paper size sensor 29. FIG. 8 shows an example in which the paper feed information is the copy speed. The copy speed is calculated through an operation shown in FIG. 9. Other paper feed information includes the preset copy quantity.

Hereinafter, the flowcharts of FIGS. 5 to 9 will be described. Referring to FIG. 5, first, at step #1, the CPU 30 waits until a copy start instruction is inputted, and when the instruction is inputted, a toner concentration signal which is the output of the toner concentration sensor 17 is sampled at step #5. Then, the toner concentration signal (sensor value) is compared with the reference level (replenishment level) at step #10 to determine whether the sensor value is higher than the replenishment level or not. When it is not higher, since sufficient toner is present in the developer unit, the process returns to step #5. When it is higher, since the toner is insufficient, the process proceeds to step #15 to determine the difference from the replenishment level.

Then, whether one-side copying is to be performed or not is determined at step #20, and in the case of one-side copying, the ON and OFF periods of the toner replenishing motor are determined to be two seconds and one second, respectively, to replenish toner. In the case of both-side copying, the process proceeds to step #30 to determine the difference from the replenishment level. The sensor value is expressed in 0 to 256 tones (bits). For example, when the reference value is 120, if the sensor value is higher than the reference value by 0 to 5 bits, the ON and OFF periods of the toner replenishing motor are set to one second and three seconds, respectively, at step #35 to replenish toner. If the sensor value is higher than the replenish level by 6 to 10 bits, the ON and OFF periods of the toner replenishing motor 35 are set to one second and two seconds, respectively, at step #40 to replenish toner.

If the sensor value is higher than the replenishment level by 11 to 15 bits, the ON and OFF periods of the motor are both set to one second at step #45 to replenish toner. If the sensor value is higher than the replenishment level by 16 bits or more, the ON and OFF periods of the motor are set to two seconds and one second, respectively, to replenish toner.

At step #55, the completion of the toner replenishment is confirmed. When the toner replenishment is completed, the process proceeds to step #60 to determine whether copying has been finished or not. When copying has not been finished, the process returns to step #5. When copying has been finished, this flow is finished. In this embodiment, in the case of both-side copying, the replenishment of toner may be small since after the completion of copying of one side, it takes some time to start the copying of the other side. Therefore, the ON period of the toner replenishing motor may be short unless the difference from the replenishment level is 16 bits or more. 0n the other hand, in the case of one-side copying, since after the completion of copying of one sheet, it does not take much time to start the copying of the next sheet, the ON period is long and the OFF period is short so that the replenishment of toner is large.

Referring to FIG. 6, whether or not the paper size is B4 or larger is determined at step #20. When it is B4 or larger, the process proceeds to step #25. When it is smaller than B4, the process proceeds to step #30. The other steps are the same as those of FIG. 5.

Referring to FIG. 7, the edit area (area which is not copied) is determined at step #3. Whether or not the edit area is one-third or more of the paper size is determined at step #20. When it is one-third or more, the process proceeds to step #25. When it is smaller than one-third, the process proceeds to step #30. The other steps are the same as those of FIG. 5.

Referring to FIG. 8, whether or not the copy speed is a predetermined speed $S_0$ or higher is determined at step #20. When it is $S_0$ or higher, the process proceeds to step #25. When it is lower than $S_0$, the process proceeds to step #30. The other steps are the same as those of FIG. 5.

Figure 9:
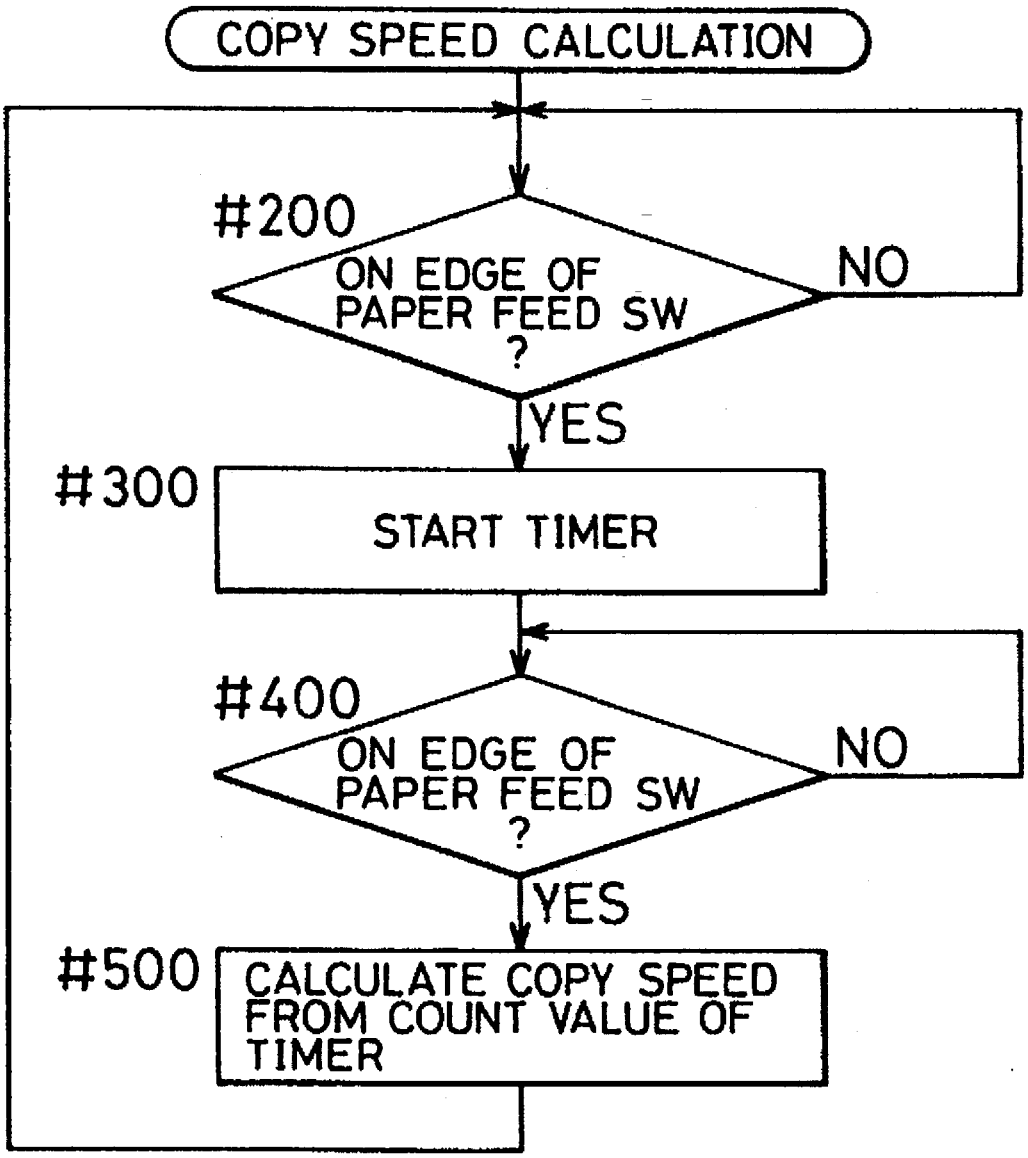
FIG. 9 is a flowchart to calculate the copy speed.

Referring to FIG. 9, there is shown a flowchart to calculate the copy speed used for the determination of step #20 of FIG. 8. In this flow, whether the paper feed switch 34 is turned on at an edge of the copy sheet (hereinafter, this will be referred to as "ON edge of the switch 34") or not is determined at step #200. When there is an ON edge of the switch 34, the timer 33 is started at step #300 and whether there is an ON edge of the switch 34 or not is determined at the next step #400. When there is an ON edge, at step #500, the copy speed is calculated based on the count value from the ON edge at step #200 to the ON edge at step #400.

As described above, according to the present invention, sufficient toner is replenished in the case of a development which requires a large amount of toner in a predetermined period of time, and a rather small amount of toner is replenished in the case of a development which does not require much toner. Thus, since toner is replenished according to toner consumption, faint images, scatter of toner and locking of the developer unit never occur.

Obviously, many modifications and variations of the present invention are possible in light of the above teachings. It is therefore to be understood that within the scope of the appended claims, the invention may be practiced other than as specifically described.

What is claimed is:

1. A toner concentration controller which activates and deactivates a toner replenishing motor to replenish a toner when a concentration of the toner in a developer unit which develops an electrostatic latent image on a photoreceptor is lower than or equal to a predetermined reference value, said toner concentration controller comprising controlling means for controlling ON and OFF periods of the toner replenishing motor based on paper feed information of a copy sheet to which a developed image is to be transferred; and wherein said paper feed information is information on whether an image is to be transferred to one side of the copy sheet or to beth sides of the copy sheet, and wherein said controlling means controls the ON and OFF periods of the toner replenishing motor so that in one-side image formation, a toner replenishment amount is larger than in both-side image formation.

2. A toner concentration controller according to claim 1, wherein in the both-side image formation, the ON period is shorter than in the one-side image formation, and the OFF period is long when a difference from the reference value is small and short when the difference from the reference value is large.

* * * * *